United States Patent [19]

Morrill, Jr. et al.

[11] 4,160,223

[45] Jul. 3, 1979

[54] PLURAL REED SWITCHES HAVING AN INTEGRAL, INTERCONNECTING WEB

[75] Inventors: Vaughan Morrill, Jr.; Stanley F. Jackes, both of St. Louis, Mo.

[73] Assignee: Morex, Inc., St. Louis, Mo.

[21] Appl. No.: 826,727

[22] Filed: Aug. 22, 1977

Related U.S. Application Data

[62] Division of Ser. No. 729,005, Oct. 4, 1976, Pat. No. 4,055,888.

[51] Int. Cl.[2] ..... H01H 1/66

[52] U.S. Cl. ..... 335/152; 335/154

[58] Field of Search ..... 335/151, 152, 154

[56] References Cited

U.S. PATENT DOCUMENTS

| | | | |
|---|---|---|---|
| 3,134,868 | 5/1964 | Shine | 337/152 X |
| 3,938,066 | 2/1976 | Morrill, Jr. | 335/151 |
| 3,967,224 | 6/1976 | Seely | 335/151 |

*Primary Examiner*—George Harris

*Attorney, Agent, or Firm*—Polster, Polster and Lucchesi

[57] ABSTRACT

Reed switches, contact sections of the reed of which bear with a predetermined positive force against inside surfaces of an elongated envelope, are made by forming combs, each including a header web and, integral with the web and projecting therefrom, a plurality of reed elements. The reed elements are parallel with one another and spaced from one another along the web. A plurality of elongated glass envelopes are mounted in a fixture, parallel with one another and spaced the same centerline-to-centerline distance as the reed elements. The reed elements of a first comb are inserted into one end of the envelopes and the reed elements of a second comb into the other end of the envelopes until the inner ends of the opposite reeds are in the desired positions lengthwise with respect to one another. The free inner end of each of the reed elements of the first comb is then forced against the inner wall of an envelope in one direction with a predetermined positive pressure; the free inner end of each of the reed elements of the second comb is similarly forced against the inner wall of the envelope in the opposite direction, and while the pressures are maintained, the reed elements are fused into the envelopes. The envelopes are preferably so made that only a broad outer surface of reed elements of rectangular cross section bears against the envelope at the contact end.

1 Claim, 12 Drawing Figures

PLURAL REED SWITCHES HAVING AN INTEGRAL, INTERCONNECTING WEB

This is a division of application Ser. No. 729,005 filed Oct. 4, 1976, now U.S. Pat. No. 4,055,888.

BACKGROUND OF THE INVENTION

Conventional glass envelope reed switch manufacture is described under Background of the Invention in U.S. Pat. No. 3,794,944; and alternative switch construction and methods are described in U.S. Pat. Nos. 3,794,944 and 3,938,066.

One of the problems in the methods of the prior art was that of keeping foreign matter out of the inside of the envelope during the manufacture, and at the same time, making a reed switch which had a strong sealing section. In some of the prior art methods, sealing was accomplished by radiant heat, rather than by flame, but this method is not only slower but, in practice, has been found to require the use of special glass which absorbs radiant energy and is substantially more expensive than the glass which would otherwise be suitable.

One of the objects of this invention is to provide an improved reed switch and method of making it, in which the seal area of the envelope is strong and production is faster and more economical than the production of reed switches known heretofore.

Other objects will become apparent to those skilled in the art in the light of the following description and accompanying drawings.

SUMMARY OF THE INVENTION

In accordance with this invention, generally stated, reed switches, the contact section of the reeds of which bear with a predetermined positive pressure against an inside surface of a glass envelope, are made by forming combs each including a header web with a plurality of reed elements integral with and of a piece with the web, parallel with one another and spaced from one another along the web. A plurality of elongated glass envelopes, preferably substantially rectangular in cross section, with two substantially parallel flat surfaces, each with two, opposite, open ends, are mounted, parallel with one another and spaced the same centerline-to-centerline distance as the reed elements, in a fixture. The reed elements of a first comb are inserted into one end of the envelopes. The reed elements of a second comb are inserted into the other end of the envelopes, and the combs are mounted in the fixture in such a way that the inner ends of the opposite reeds are in the desired positions lengthwise in respect to one another. The free inner end of the reed elements of the first comb are forced against the inner wall of the envelopes in one direction. The free inner end of the reed elements of the second comb are forced against the inner wall of the envelopes in the opposite direction, each reed element asserting a positive, predetermined pressure against the envelope wall. In this condition, the gap between the inner ends is determined solely by the spacing of the facing bearing surfaces of the envelopes and the thickness of the reed elements. Then, while the positions and pressures of the reed elements are maintained, the reed elements are fused into the envelopes in an area outboard of the inner ends of the reed elements. The outboard ends of the envelopes are permitted to move inwardly during the fusing process, to supply glass to the sealing section. The sealing areas of the envelopes are cooled, fixing the reed elements in their desired relative positions and with the predetermined positive pressures. One of the header webs is removed, the other being used as a common connection for gang testing of the reed switches attached to it. The reed switches are tested, and the other web is removed. If desired, the envelopes of the reed switches can be trimmed by removing a part of the ends outboard of the fused area, and the reed switches are then ready for use.

DESCRIPTION OF THE PREFERRED EMBODIMENT

Figure 11:
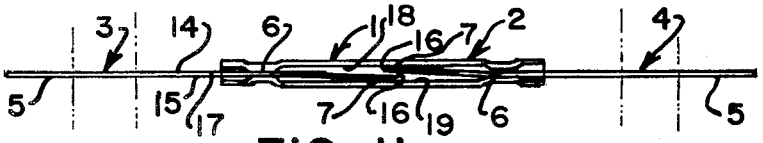
FIG. 11 is a view in side elevation of a completed reed switch.
Figure 7:
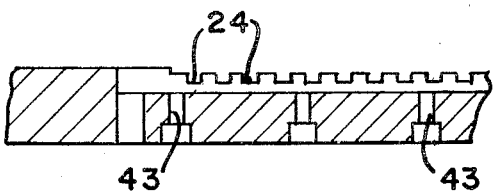
FIG. 7 is a fragmentary sectional view taken along the line 7—7 of FIG. 2.

Referring now to the drawings for an illustrative embodiment of this invention, and first to FIG. 11, reference numeral 1 indicates a reed switch of this invention made by a process of this invention. The reed switch 1 has a glass envelope 2, which is preferably substantially rectangular in cross section through its central span, with substantially flat, wide upper and lower inner surfaces 18 and 19 respectively. The wide upper and lower inner surfaces 18 and 19 can be provided with an integral longitudinal rib or parallel ribs or made slightly convex, but in any event they preferably have a configuration which permits a flat surface of a reed to bear upon an inner surface of the envelope, as explained hereinafter. Suitable envelopes are illustrated and described in U.S. Pat. No. 3,938,066. Reeds 3 and 4 are sealed into the envelope. Each of the reeds 3 and 4 has a lead section 5, a seal section 6 and a contact section 7. The reeds are preferably rectangular in transverse cross section, with relatively broad, flat, parallel top and bottom surfaces 14 and 15, and relatively thin side surfaces 17. Inner ends 16 of the reeds overlap within the envelope.

Figure 8:
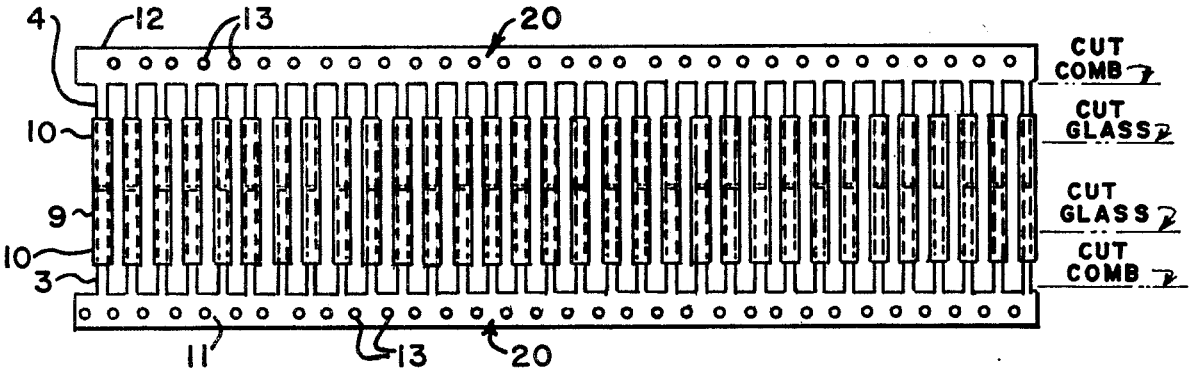
FIG. 8 is a top plan view of combs and glass envelope tubes showing their relative positioning during several stages of the manufacture of reed switches.
Figure 10:
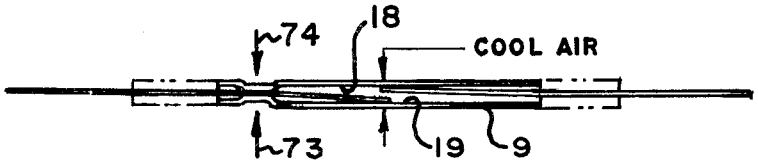
FIG. 10 is a view in side elevation of a reed switch at an incomplete stage in the process.

Referring now to FIGS. 8 and 10, the envelope 2 of each reed switch is made from an envelope tube 9 which, in the preferred embodiment, has offal sections 10.

Initially, the reeds 3 for a multiplicity of reed switches are formed of a piece with a web 11, and the reeds 4 are made of a piece with a web 12; the web and reeds together constitute what is sometimes referred to herein as a comb 20. The combs of reeds 3 and those of reeds 4 can be identical. The webs of the combs 20 have in them locating holes 13.

The combs are precisely made in such a way that they are flat and without camber (arcing) within the plane in which they lie. The reeds are equally spaced and parallel with one another and perpendicular to the web.

Referring now to FIGS. 9 and 1–6, a fixture 21 is used in the embodiment of method described hereinafter in the production of the reed switches 1. The fixture 21 is made up of an upper block 22, a lower block 23, fulcrum bars 35, and cap screws not here shown.

Each of the upper and lower blocks has milled in one broad, inside, flat, facing, surface, envelope sets 24, parallel with one another and spaced from one another the same centerline-to-centerline distance as the reeds of the combs 20. In the embodiment shown there are 32 such seats. The seats 24 of the two blocks are positioned to coincide when the blocks are assembled as a fixture and are dimensioned to accommodate the envelope tubes 9. The envelope tubes 9 fit in the seats closely, but slidably. In the embodiment shown, the seats 24 stop short of one long edge of the blocks and extend through the opposite edge. A gas admission channel 25 runs the full length of the lower block 23, parallel to the long edge through which the seats do not extend, and inboard of the closed ends of the seats 24, as shown particularly in FIG. 2. A gas admission channel 26 runs the full length of the upper block 22 parallel to the long side through which the seats 24 do not extend, and the same distance inboard of the long side as the channel 25 of the lower block, so that the channels coincide when the fixture is assembled.

A gas outlet channel 27 is formed in the lower block 23 parallel with the long side of the block through which the seats 24 extend, and extending lengthwise past the end seats, but terminating short of the ends of the block. The gas outlet channel 27 communicates at its ends with outlet ports 57 extending through the block. A gas outlet channel 28 is formed in the upper block 22 parallel with the long side of the block through which the seats 24 do extend, and is of the same length, width and relative position as the gas outlet channel 27. The gas outlet 28 communicates at its ends with outlet ports 58 which extend through the block. The channels 26 and 27 also serve as seats for fulcrum bars 35.

Each of the fulcrum bars 35 has a flat bottom surface 32 and parallel, relatively narrow side surfaces. Its upper surface has a chamfer 36 along one edge and a bearing surface 34 which angles slightly divergently with respect to the flat bottom surface 32, as shown particularly in FIG. 4. The fulcrum bar 35 has tapped machine screw receiving holes 33 along it. The upper and lower blocks have countersunk untapped fulcrum bar screw holes 43, through which screws, not here shown, extend into the tapped holes 33 to mount the fulcrum bars 35 in their respective channels, as shown particularly in FIG. 9.

The bottom block 23 has tapped cap screw holes 39 at four symmetrically placed locations outboard of the seat area, and two tapped cap screw holes 41 and 42 near but not on the transverse centerline of the block, and located entirely between two of the seats 24.

Upper block 22 has countersunk untapped cap screw holes 49 corresponding in location to the tapped holes 39 in the lower block 23, and untapped cap screw holes 51 and 52 corresponding in location to tapped cap screw holes 41 and 42 respectively.

Figures 1, 2, 3, 4, 5, 6:
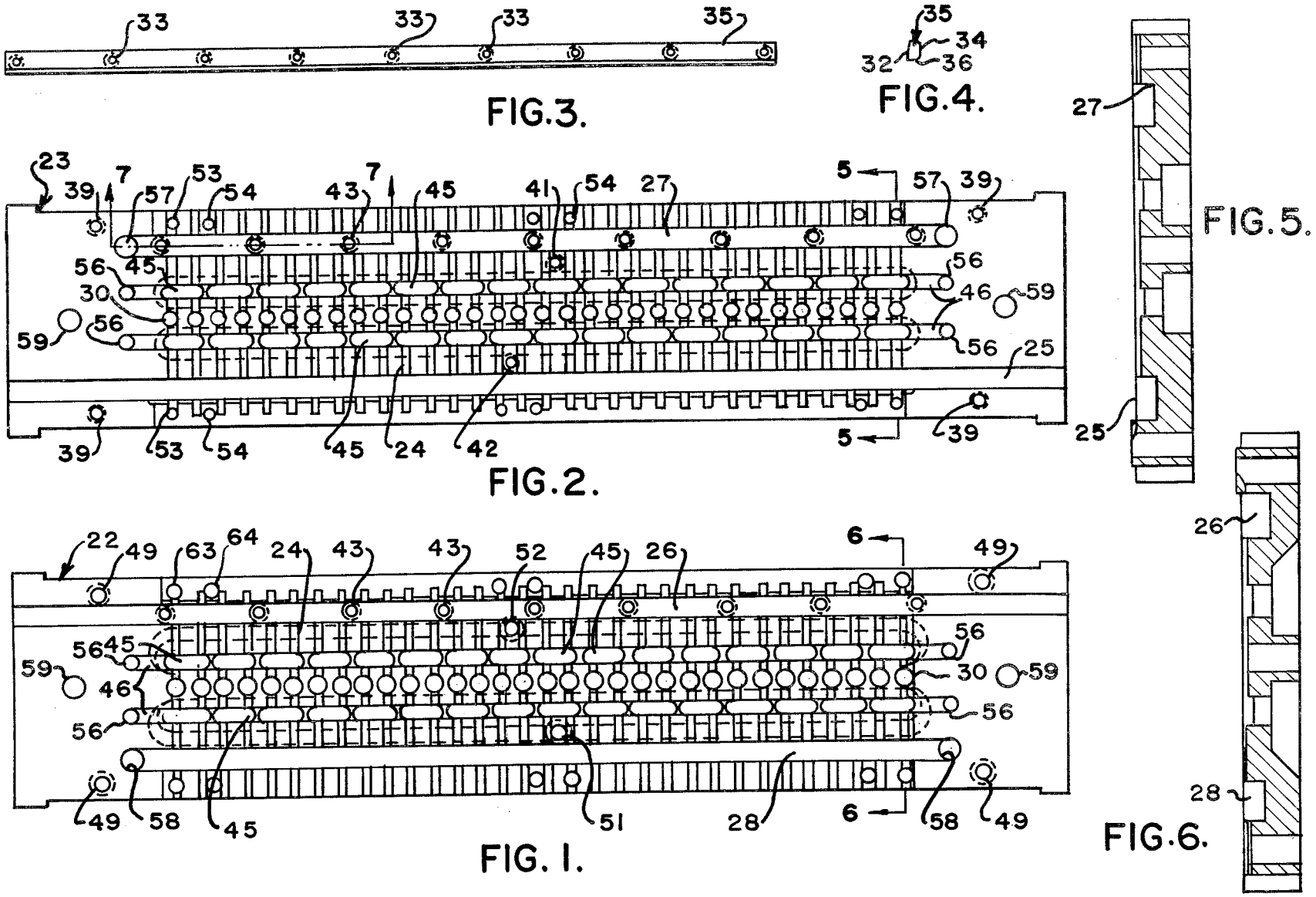
FIG. 1 is a bottom plan view of an upper block part of a fixture used in one embodiment of process of manufacture of reed switch of this invention.
FIG. 2 is a top plan view of a lower block part of the same fixture.
FIG. 3 is a plan view of a fulcrum bar element of the same fixture.
FIG. 4 is a view in end elevation of the fulcrum bar shown in FIG. 3.
FIG. 5 is a sectional view taken along the line 5—5 of FIG. 2.
FIG. 6 is a sectional view taken along the line 6—6 of FIG. 1.
Figure 9:
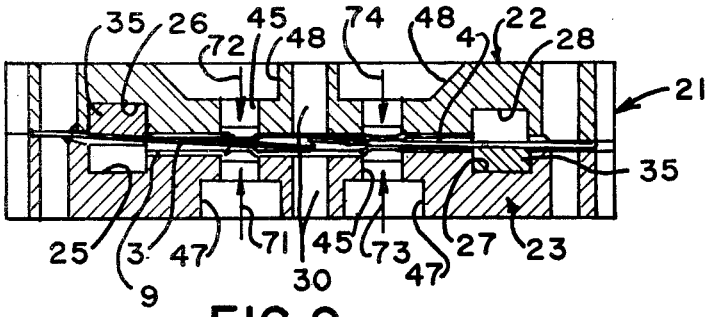
FIG. 9 is a transverse sectional view taken in the same direction as sections 5—5 and 6—6, showing the top and bottom blocks of the fixture in position with the combs and envelopes of FIG. 8 in place.

The seats 24 are interrupted transversely not only by the channels 25, 26, 27 and 28, but by fire or heat ports and cooling ports. In both blocks, cooling gas ports 30 have their centers located at the intersection of the longitudinal centerline of the blocks and the centerlines of all of the seats 24. Flame or heat ports 45 are symmetrically positioned on either side of the cooling ports 30. Each of the heat ports 45 is an elongated slot extending between, across and slightly beyond two seats 24. The heat ports 45 of the lower block 23 communicate with channels 46 which run lengthwise of the block across the seats 24, and are slightly deeper than the seats 24. The channels 46 terminate in ports 56 extending through the blocks. At their other ends, the ports 45 of the lower block 23 communicate with channels 47 formed in the outer, broad surface of the block opposite the surface in which the seats 24 lie. The ports 45 in the upper block 22 communicate at their outer ends with channels 48, which are wider than the channels 47, and chamfered along an outboard edge as well, as best shown in FIG. 9, and indicated in FIG. 1 in dotted lines.

In this embodiment, locating and guide pin holes 59 are located near the outer ends of the blocks 22 and 23 on the longitudinal centerline of the blocks. They are formed and positioned to accept locating pins on a base, to assist in the assembly of the blocks to form the fixture.

The most important locating holes are comb locating holes 53 and 54 in the lower block 23 and 63 and 64 in the upper block. The holes 53 and 54 are smaller than the holes 63 and 64, to take a small shank of a shouldered pin a longer, larger section of which projects through and beyond the holes 63 and 64 of the upper block to permit their removal, as will be explained hereafter. There are six comb locating holes 53, three along each long edge, and also six comb locating holes 54. It will be observed that the locating holes 53 are located on cenerlines of seats 24, whereas the holes 54 are centered between successive seats 24. In the embodiment shown, only locating holes 54 and 64 are used, to accommodate holes 13 in the webs of the combs 20 shown in FIG. 8. If it is desired to distinguish one comb from another, the holes 13 can be formed in one web in alignment with the long axis of the reeds. In the embodiment described, since the combs 20 are identical, it is unnecessary to do so.

Figure 12:
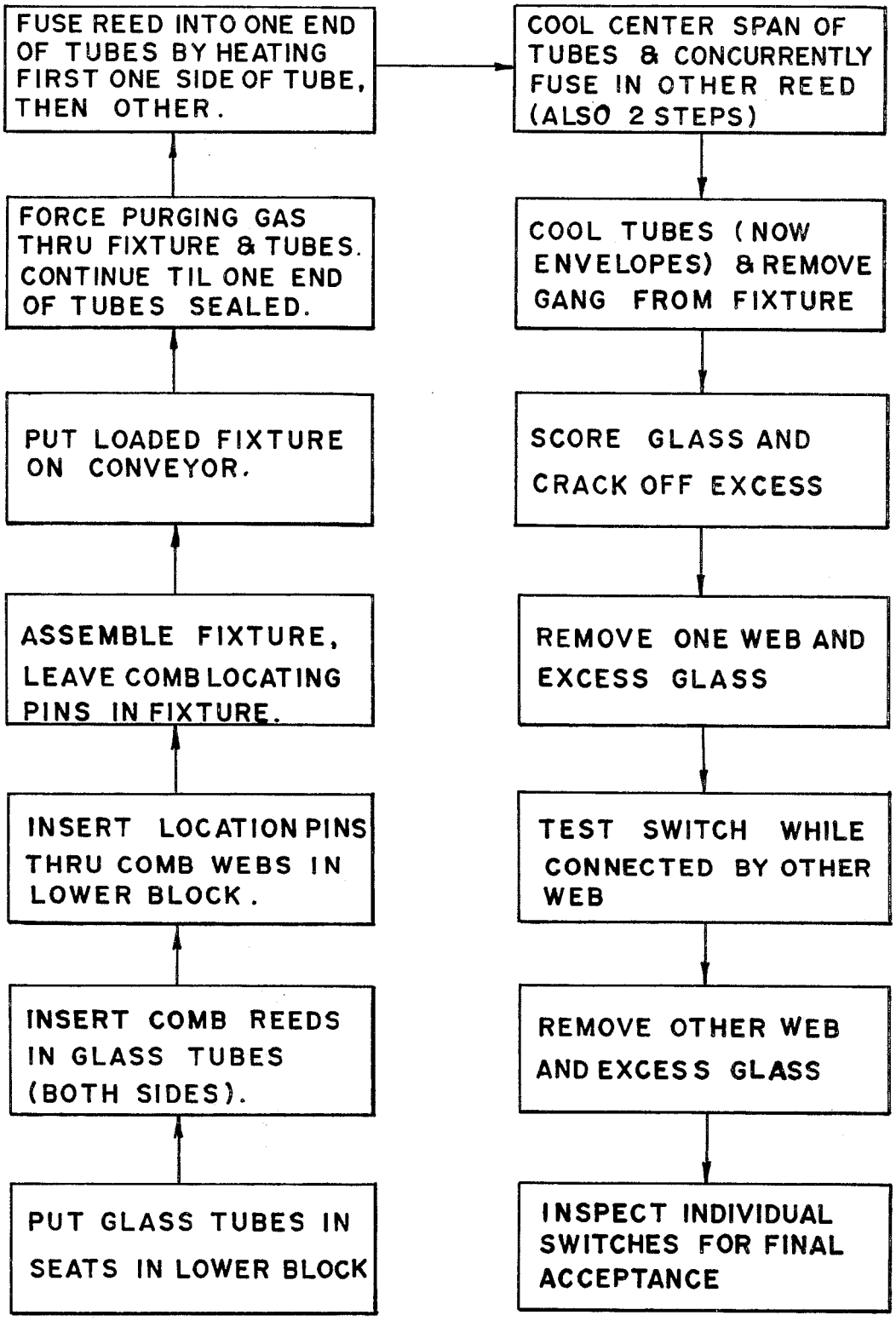
FIG. 12 is a block flow diagram setting out steps in the illustrative embodiment of method described.

In one illustrative embodiment of method of this invention, the steps of which are outlined in FIG. 12, the envelope tubes, cut to the appropriate length, are laid in the envelope seats 24 of a lower block 23 with a broad flat side down. One comb 20 is positioned so that reeds 4 are aligned with the open ends of the tubes, and the reeds are then inserted into the tubes from one side, in the embodiment illustrated, from the upper edge as viewed in FIG. 2, over the fulcrum bar 35 in the channel 27.

A comb 20 with reeds 3 is then positioned so that the reeds 3 are aligned with the opposite open end of the envelope tubes, and the reeds are inserted into the tubes and beneath the ends of the reeds 4, so that they overlap slightly as shown in FIG. 9.

If the tubes are not absolutely lined up lengthwise of the seats 24, they can be squared as by a straight edge.

However, it can be seen that because the positions of the reeds are absolutely fixed, and the envelope tubes have a substantial offal section, misalignments or use of tubes not of exactly the same length is not a problem. The shanks of the shouldered locating pins, not here shown, are run through the appropriate holes 13 in both of the webs, and into the proper locating holes 54 in the lower block. The holes 54 are precisely positioned and they and the locating pin shanks are very closely dimensioned with respect to the holes 13, which in turn are precisely located with respect to the reeds, so that when the pins are in place, the amount of overlap of the ends of the reeds is precisely determined.

If the lower block 23 has not already been set on locating and guide pins extending from a base through the holes 59, it is now put on those pins. The upper block is then put into position on top of the lower block. The comb locating pins project through and past the holes 64 far enough to permit their removal after the fixture has been fully assembled. Cap screws are now inserted with their threaded shanks extending through the holes 49, 51 and 52 and are screwed into holes 39, 41 and 42, respectively, to clamp the upper and lower blocks tightly together. When the upper and lower blocks are clamped tightly together, the reeds 4 are forced upwardly by the inclined surface 34 of the fulcrum bar 35 in the channel 27 of the lower block, while the reeds 3 are forced downwardly by the inclined surface 34 of the fulcrum bar 35 in the channel 26 of the upper block. The web, hence the outer end of the lead section 5 of each reed, is held in such a way that the amount of pressure exerted by the contact section 6 against the inner wall of the envelope tube by virtue of the inclination and projection of the surface 34 of the fulcrum bar is exactly predetermined. When the cap screws have been tightened to the place at which the meeting surfaces of the two blocks solidly engage, the fixture is removed from the base guide pins. The loaded fixture is put on a conveyor belt, where it is aligned with its long axis perpendicular to the axis of travel of the belt. Purging gas, which in this embodiment is a mixture of nitrogen and hydrogen, is introduced to the open ends of channel 25. Gas flows through the tubes into the channel 28, and exhausts to the atmosphere through the exhaust ports 58. The fixtures are heated to preheat the tubes.

In this embodiment the fixture is delivered by the belt to a fusing station, where it is passed over a gas flame or flames the products of combustion of which come through the channel 47 and one set of ports 45 on the side opposite the gas admission channel 25, thus adjacent the channel 27, as indicated by the arrow marked 73 in FIGS. 9 and 10. The fixture then moves under a gas flame or flames directed downwardly through the channel 48 and set of heating ports 45 in the upper block adjacent the channel 28, as indicated by the arrow marked 74 in FIGS. 9 and 10. The flow of purging gas continues during this first sealing and reed fusing process, until a seal has been formed at one end of the tubes. During this sealing and fusing operation, because the outboard end of the envelope tube has been free to slide, the center section having been held in place by the pressure of the reeds on the inside wall, the glass from the outboard end has been free to move inwardly to thicken at the sealing area.

As the fixture moves and the purging gas continues to flood the open end of the glass tube, products of combustion from a flame or flames from beneath the fixture pass into the channel 47, hence through the heating ports 45 at the other end of the tube, adjacent the channel 25, as indicated by the arrow marked 71 in FIG. 9. At this point, cooling gas, which can be air, is forced through the cooling ports 30, and the cooling process is continued as the fixture passes beneath a flame or flames, the products of combustion of which pass into the channel 48 and heating ports 45 of the upper block adjacent the channel 26, as indicated by the arrow marked 72 in FIG. 9, to seal the tubes, forming the envelopes of the reed switches, and fusing the reeds into the envelopes. As is the case with the other seal, the outboard, offal, end of the tube moves inwardly to supply glass to the seal area as the sealing-fusing progresses.

The reason for the cooling is to prevent distortion of the envelope by the entrapped purging gas, which otherwise might expand sufficiently to produce a bubble at the sealing area.

The envelopes are permitted to cool below the softening temperature of the glass, so that the reeds are frozen into the desired position and with the predetermined pressure of the contact section against the inner wall of the envelope. The cap screws are removed and the fixture blocks separated, and the gang of reed switches with their connecting webs is removed.

In the preferred embodiment, one web is cut from the lead sections of the reeds, and the free lead sections are electrically connected to individual receptacles of testing apparatus, which can be a simple plug-in step. The web which has not been removed is connected electrically to another lead of the testing apparatus, and the switches are all tested automatically, the attached web serving as a common conductor. After the testing, the remaining web is cut from the lead section of the reeds. If desired, the envelopes can be trimmed by cutting off excess glass outboard of the sealing sections, as indicated in FIGS. 8 and 10, and the switch is ready for use. In practice, the tubes have been scored and the offal sections cracked off before the webs have been removed, the resulting sleeves sliding off when the webs are removed, but this is a matter of choice.

It can be seen that because the ends of the envelope tube project a substantial distance beyond the area at which the products of combustion of the flame impinge upon the envelope, because the open ends are well protected from those products and because the flow of purging gas continues through all of the sealing operations, it is possible in the method of this invention to use gas flame sealing without contaminating the reeds within the envelope.

Numerous variations in the reed switch and method of manufacture of this invention within the scope of the appended claims will become apparent to those skilled in the art in the light of the foregoing disclosure. Merely by way of illustration, while in the illustrative embodiment shown, the initial tube length of 1" and its finished length 0.6", and the reeds are 0.007" × 0.048" × 1", and the gap is 0.0010", the process can be used for envelopes and reeds of a wide variety of lengths and gap sizes. The combs may be made with any number of reeds, as long as the fixture has enough seats to accommodate them. As has been indicated, the use of a rectangular, ribbed, or slightly convex inner surfaced envelope tube makes the gap size independent of the width of the reeds, whereas, in a round envelope, the gap is dependent upon the width of the reed when the bearing of the reeds on the inside surface of the envelope is relied upon to determine the gap. Accordingly, the non-circular form is preferred, but if the tubing and reed are made precise enough, circular tube envelopes can be used in Applicant's method. The various ports, channels, locating pins and holes can be varied. Independently heated gas can be used as the fusing agent instead of flame or products of combustion, or, if special glass is used, infra-red radiation, but the preferred method described has advantages of effectiveness and economy. The purging gas can be any gas with which the switch is to be filled when it is sealed, and more than one kind of gas can be used, first to purge and then to fill the envelope. If the center section of the tube is cooled adequately, the two ends of the tube can be sealed concurrently, although the preferred embodiment of method described has been found to produce optimum results. These variations are merely illustrative.

Having thus described the invention, what is claimed and desired to be secured by Letters Patent is:

1. An article of manufacture comprising a multiplicity of reed switches each having a glass envelope and two, electrically conductive reeds each with a seal section fused into said envelope and a reed section projecting from said envelope, said switches being in parallel, spaced, side by side relation to one another, and an electrically conductive web integral with and of a piece with all of the lead sections of reeds projecting from one end of said switches.

* * * * *